US005941755A

United States Patent [19]

Danielian

[11] Patent Number: 5,941,755

[45] Date of Patent: Aug. 24, 1999

[54] TOY HAVING JUMPING ACTION

[75] Inventor: Armen Danielian, Woodland Hills, Calif.

[73] Assignee: Mattel, Inc., El Segundo, Calif.

[21] Appl. No.: 09/020,023

[22] Filed: Feb. 6, 1998

[51] Int. Cl.[6] ..... A63H 11/06; A63H 11/00

[52] U.S. Cl. ..... 446/312; 446/353

[58] Field of Search ..... 446/312, 311, 446/310, 309, 308, 307, 320, 353

[56] References Cited

U.S. PATENT DOCUMENTS

| | | | |
|---|---|---|---|
| D. 226,772 | 4/1973 | Ehrenreich | 446/311 X |
| D. 226,773 | 4/1973 | Ehrenreich | 446/311 X |
| 753,109 | 2/1904 | Poppenhusen | 446/353 |
| 2,425,429 | 11/1947 | Hansen . | |
| 2,627,700 | 2/1953 | Weiss | 446/312 |
| 2,824,409 | 2/1958 | Brodrib | 446/312 |
| 3,200,538 | 8/1965 | Glass et al. . | |
| 3,452,473 | 7/1969 | Convertine | 446/353 |
| 3,603,030 | 9/1971 | Bart | 446/307 |
| 4,037,357 | 7/1977 | Monroe et al. . | |
| 4,308,686 | 1/1982 | Ikeda . | |
| 4,411,099 | 10/1983 | Cancel . | |
| 4,545,775 | 10/1985 | Kim . | |
| 4,913,676 | 4/1990 | Koguchi et al. | 446/353 X |
| 5,074,820 | 12/1991 | Nakayama . | |
| 5,356,326 | 10/1994 | Ting . | |
| 5,690,330 | 11/1997 | Ozawa | 446/309 X |

*Primary Examiner*—D Neal Muir
*Attorney, Agent, or Firm*—Roy A. Ekstrand

[57] ABSTRACT

A toy producing a jumping or bouncing action includes an outer body depicting a fanciful animal and an interior support structure which includes an elongated body housing having a head portion and supporting a tail portion. A pair of leg units having a corresponding pair of supporting feet are slidable within the body housing and are joined by a transversely extending leg unit bridge. A gear drive unit includes an electric motor and a plurality of drive gears which rotate a gear segment. The gear segment engages a gear rack on the leg unit bridge and is operative when the motor is energized to drive the toy figure toward a squatting position as the leg units are drawn into the body housing. A spring is coupled between the leg unit bridge and the body housing and is stretched as the gear segment rotates lifting the gear rack. When the teeth of the gear segment move out of engagement with the gear rack, the spring produces a thrusting force upon the leg units causing the toy to bounce or jump. The action repeats until a timer within a control unit operative upon the motor has timed out a predetermined interval.

8 Claims, 4 Drawing Sheets

TOY HAVING JUMPING ACTION

FIELD OF THE INVENTION

This invention relates generally to dolls and toy figures and particularly to those having soft padded "plush" bodies.

BACKGROUND OF THE INVENTION

Plush toys have been provided in a virtually endless variety taking outer forms corresponding to dolls, toy figures, animal figures and fanciful characters. While their appearance has differed substantially as practitioners have endeavored to provide evermore interesting and entertaining plush toy figures and plush toys, all generally follow the characteristic of providing a padded soft outer body covered with a soft flexible fabric. In many plush toys, the outer fabric includes an outer simulated "fur" or other textural characteristic. The most typical and pervasive type of plush toy provides some sort of head and appendages with the head often defining various facial features such as mouth, nose, eyes, ears and the like.

In many plush toys, the padded outer body and flexible outer fabric is supported upon a relatively rigid interior skeleton-like structure. Often, the skeleton-like structure is articulated having movable joints which facilitate movement of appendages such as arms, legs and head. More sophisticated skeletal supports include mechanisms for facilitating movement of the mouth and other features. More recently, simple skeletons used for articulation and support of the plush outer body have been replaced by more complex motor driven battery-powered movement and action mechanisms. Accordingly, plush toys have provided figures which simulate various movement patterns such as walking, running, kicking and so on. Further improvements have included the provision of internal battery-powered sound producing apparatus which may either be cyclically operated or touch-responsive as pressure sensitive switches and the like are positioned about the plush body.

Thus, practitioners in the art have continuously endeavored to enhance the sophistication, amusement and appeal of plush toys by providing evermore interesting toys. For example, U.S. Pat. No. 5,074,820 issued to Nakayama sets forth a STUFFED VIBRATING SOUNDING SITTING TOY having a stuffed body supporting a main switch therein responsive to externally applied loads which controls a vibrator activated when the main switch is turned on to vibrate at least a portion of the stuffed toy. The toy further includes a sound generator producing a sound while the vibrator is active.

U.S. Pat. No. 4,037,357 issued to Monroe, et al. sets forth a JUMPING TOY configured to generally resemble a squatting frog and having a base member which supports a clockwork connected through a gear train to a movable shaft which in turn carries a spring-biased thrust rod. The movable shaft supports a gear which is maintained in engagement with a fixed gear rack. Activation of the clockwork urges the thrust rod against the bias of the spring and another gear carried by the movable shaft is cyclically engaged and disengaged by a sector gear and caused cyclical oscillation of the thrust rod. Sufficient force is developed against the support surface to cause the toy to jump upwardly from the surface.

U.S. Pat. No. 5,356,326 issued to Ting sets forth a SHAKING TOY having a plush toy figure incorporating a motion generating apparatus activated by a sound sensing transducer. The motion generating apparatus shakes the figure causing a swinging action to be imparted thereto.

U.S. Pat. No. 4,308,686 issued to Ikeda sets forth a TOY HAVING APPENDAGE CAPABLE OF MOVING IN TWO DIRECTIONS in which a pair of leg appendages are pivotally supported upon a body resembling a frog or the like and a spring drive is coupled to the pivotable appendages whereby energy is stored in the spring with the appendages in a cocked position and released to produce a jumping action as the legs pivot.

U.S. Pat. No. 3,200,538 issued to Glass, et al. sets forth an ELECTRICALLY POWERED AND SOUNDING TOY BIRD having a battery-powered movable skeleton supported within a bird-like body which is operative to perform predetermined traveling movements on a supporting surface and which is able to produce various sounds.

U.S. Pat. No. 4,545,775 issued to Kim sets forth a DANCING HULA DOLL which alternatively moves its hips left and right to give a likeness which compares to an actual hula dancer. The doll includes an upper portion, a lower portion and a base portion together with apparatus for moving each portion relative to the other.

U.S. Pat. No. 4,411,099 issued to Cancel sets forth a SINGING ELECTRONIC FROG providing a sound-producing toy in the shape of a frog including a stationary base and an upwardly pivotal body in which the body pivotal motion controls the circuit of a battery-powered sound system.

U.S. Pat. No. 2,425,429 issued to Hansen sets forth a FIGURE TOY and U.S. Pat. No. 2,953,869 issued to Collischan sets forth a TOY FIGURE, both of which are illustrative of early apparatus for producing movable animal-like toy figures.

While the foregoing described prior art devices have in various ways improved the toy art and in some instances enjoyed commercial success, there remains nonetheless a continuing need in the art for evermore interesting, amusing, improved and inventive toy figures.

SUMMARY OF THE INVENTION

Accordingly, it is a general object of the present invention to provide an improved plush toy. It is a more particular object of the present invention to provide an improved plush toy having a jumping action which operates in an interesting and amusing cycle of activity. It is a still more particular object of the present invention to provide an improved plush toy having an interesting and amusing jumping action which may also be operated in a non-powered manual play mode.

In accordance with the present invention, there is provided a toy having a jumping action comprising: a body housing defining an interior cavity; a pair of leg units having a pair of feet and being slidably supported by the body housing between an extended position and a retracted position; a gear drive operative upon the pair of leg units to move the leg units from the extended position to the retracted position and releasing the pair of leg units; spring means for urging the pair of leg units toward the extended position; and an outer body providing a flexible covering for the body housing, the pair of leg units and the feet.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
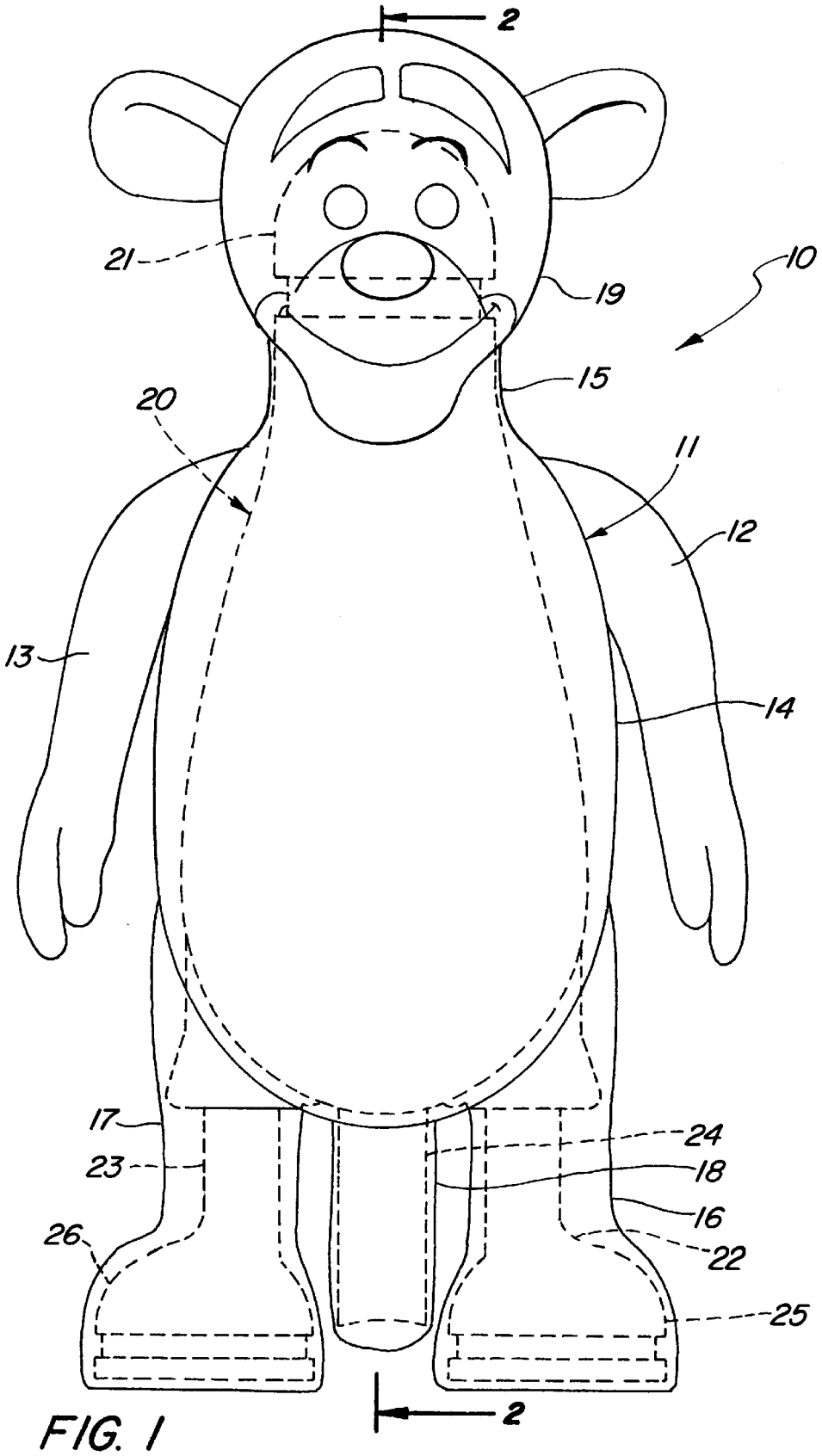
FIG. 1 sets forth a front view of a plush toy constructed in accordance with the present invention.

FIG. 1 sets forth a frontal view of a plush toy constructed in accordance with the present invention and generally referenced by numeral 10. Plush toy 10 defines an outer body generally referenced by numeral 11 which is designed to exhibit an appearance which generally corresponds to a cartoon-like animal figure. However, it will be apparent to those skilled in the art that outer body 11 may be configured in appearance to suggest or exhibit a variety of appearance characteristics such as different animals, humans, or cartoon fanciful figures without departing from the spirit and scope of the present invention. The general structure of outer body 11 defines a torso portion 14 supporting a pair of arms 12 and 13 and an upwardly extending neck 15. Neck 15 supports a head 19 which, in accordance with the cartoon-like or fanciful animal appearance of outer body 11, supports various appearance features such as eyes, nose, mouth and ears. Torso 14 further supports a pair of leg portions 16 and 17 extending downwardly therefrom.

Plush toy 10 further includes a supporting body housing 20 fitted within torso 14 and extending upwardly through neck area 15 of outer body 11. A head support 21 extends upwardly from body housing 20. Body housing 20 further supports a pair of downwardly extending leg units 22 and 23 which in turn support feet 25 and 26 respectively. Leg units 22 and 23 as well as feet 25 and 26 are covered by leg portions 16 and 17 of outer body 11. In addition, a tail unit 24 extends downwardly and rearwardly from body housing 20 and provides shape and support for a tail 18 formed of plush material corresponding to outer body 11.

In accordance with an important aspect of the present invention set forth below in greater detail, legs units 22 and 23 supporting feet 25 and 26 are movable between the extended position shown in FIG. 1 and a contracted or "squatting" position (shown in dashed-line representation in FIG. 2) in which leg units 22 and 23 are moved upwardly into body housing 20. The flexible fabric of leg portions 16 and 17 of outer body 11 accommodates this contraction or squatting movement of leg units 22 and 23. In further accordance with the present invention and as is described below in greater detail, the user initiates an operative cycle of plush toy 10 by forcing the upper portion of outer body 11 downwardly upon feet 25 and 26 causing leg units 22 and 23 to be forced into body housing 20 and to momentarily latch in a squatted position. This downward movement of body housing 20 upon leg units 22 and 23 initiates an operative cycle in which plush toy 10 appears to squat for a brief time interval and thereafter initiate a plurality of repeated bouncing or jumping actions as leg units 22 and 23 are repeatedly drawn upwardly into body housing 20 and thereafter moved downwardly in a rapid extension which launches plush toy 10 in a bouncing motion. After a predetermined time interval which preferably corresponds to five to eight jumping cycles, the operation of plush toy 10 terminates and toy 10 again assumes the standing position shown in FIG. 1.

In further accordance with the present invention and as is set forth below in greater detail, the operative cycle of plush toy 10 also includes the production of various sounds which are timed and coordinated to the bouncing or jumping motions of the operative cycle. During the movement of leg units 22 and 23 within and from body housing 20, the soft outer fabric from which leg portions 16 and 17 of outer body 11 are formed provide accommodation for the extension and contraction of the leg portions of plush toy 10.

Figure 2:
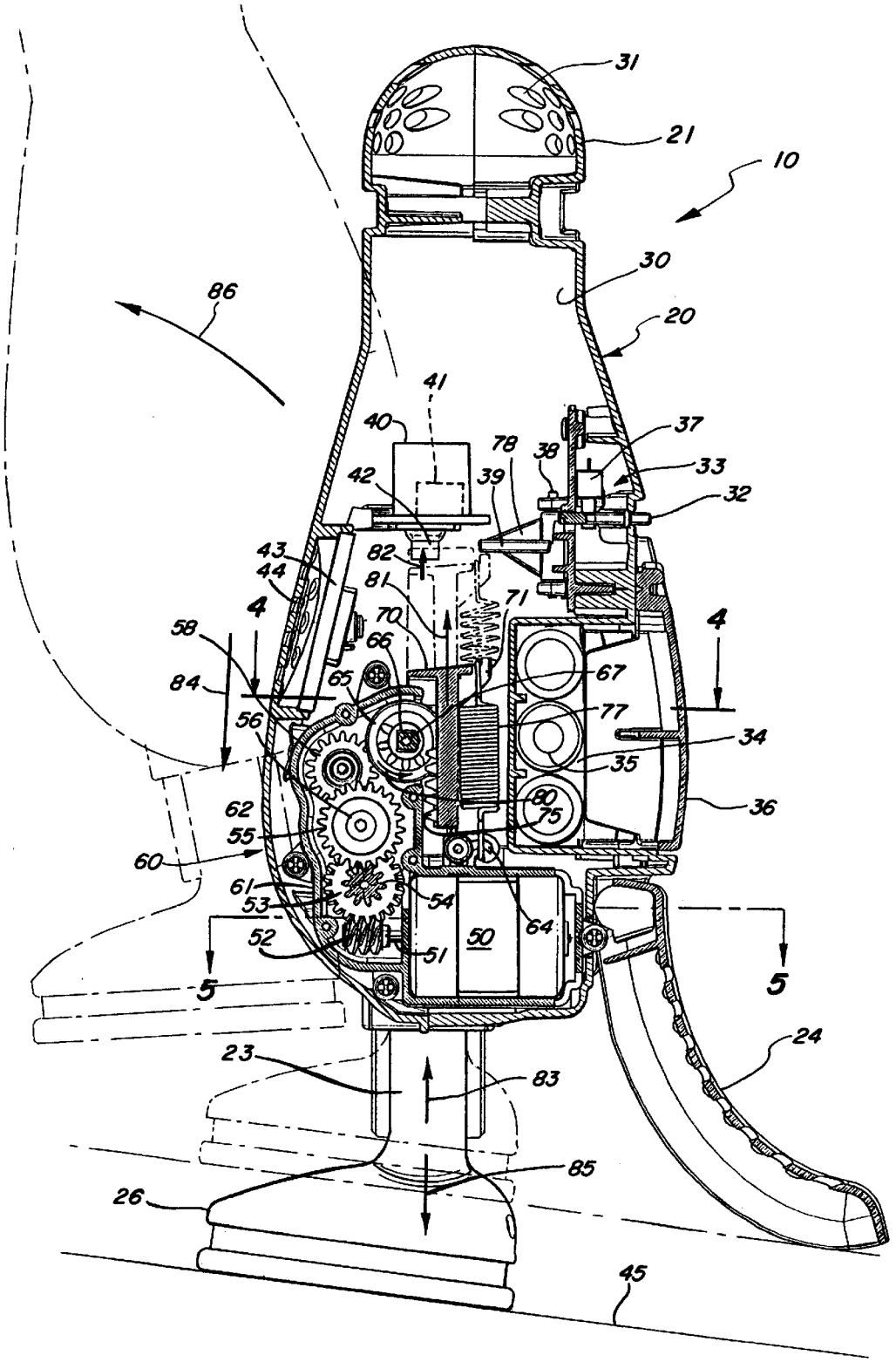
FIG. 2 sets forth a section view of the operative mechanism within the toy of FIG. 1 taken along section lines 2—2 therein.

FIG. 2 sets forth a section view of toy 10 taken along section lines 2—2 in FIG. 1. For purposes of illustration, outer body 11 is omitted from FIG. 2. As described above, toy 10 includes a body housing 20 providing the basic supporting structure for toy 10 which includes a head portion 21 and which receives leg units 22 and 23. The latter support feet 25 and 26 (foot 25 shown in FIG. 1). In accordance with the present invention, leg units 22 and 23 are joined to a leg unit bridge 70 (seen in FIG. 3) which facilitates the movement of leg units 22 and 23 in unison in accordance with the operative jumping or bouncing mechanism set forth below in greater detail. Of importance with respect to the present invention is the support of leg units 22 and 23 together with leg unit bridge 70 in a sliding manner which allows the combined structure of leg units 22 and 23 together with leg unit bridge 70 to move upwardly into interior cavity 30 of body housing 20 and outwardly or downwardly therefrom to provide the bouncing or jumping action of toy 10.

Body housing 20 further supports a switch assembly 33 which includes a switch button 32 extending outwardly from body housing 20 and a stop 39 extending inwardly within interior cavity 30. Switch button 32 and stop 39 are formed as an integral unit as is better seen in FIG. 3 and are pivotally secured within interior cavity 30 at a pivot 38. An electrical switch 37 is interlocked with switch button 32 and is operative to provide an electrical switching action as button 32 is moved transversely upon body housing 20 due to the pivotal support of pivot 38. Body housing 20 further defines a battery compartment 34 supporting a plurality of conventional batteries 35 together with appropriate electrical contacts (not shown) fabricated in accordance with conventional fabrication techniques to provide electrical connection between batteries 35. Housing 20 further includes a battery compartment door 36 providing closure of compartment 34 which is secured using conventional fasteners (not shown).

A control unit 40 having a switch 42 and a timer 41 is supported within interior cavity 30 and is constructed in accordance with conventional fabrication techniques. A speaker 43 is supported within interior cavity 30 and is positioned in close association with a speaker grille 44.

A gear drive unit 60 is supported within interior cavity 30 and includes a housing 61 supporting an electric motor 50 and a plurality of drive gears. Motor 50 is fabricated in accordance with conventional fabrication techniques and includes an output shaft 51 supporting a worm gear 52. Gear drive unit 60 further includes a gear 53 engaging worm gear 52 having a smaller gear 54 secured thereto. Gear 54 in turn engages a gear 55 supporting a clutch assembly 56. Clutch assembly 56 is set forth below in FIG. 3 in greater detail. However, suffice it to note here that clutch assembly 56 accommodates a force release within gear drive unit 60 in the event the drive unit encounters an obstruction or abuse by the user. As is better seen in FIG. 3, clutch unit 56 couples gear 55 to a somewhat smaller gear 57 which in turn engages gear 58. Gear 58 is further coupled to a gear 59 (seen in FIG. 3) which in turn is coupled to a gear segment 62. Of importance with respect to the operation of the present invention structure, gear segment 62 is a partial gear having gear teeth disposed on approximately one half of the gear periphery. Gear 62 is supported by a shaft 67 and includes a square interlock 66. Interlock 66 joins gear 62 to a rotatable cam 65 causing cam 65 to rotate in unison with gear segment 62. Thus, rotation of motor output shaft 51 provides a corresponding rotation of gear segment 62 and cam 65.

Figure 3:
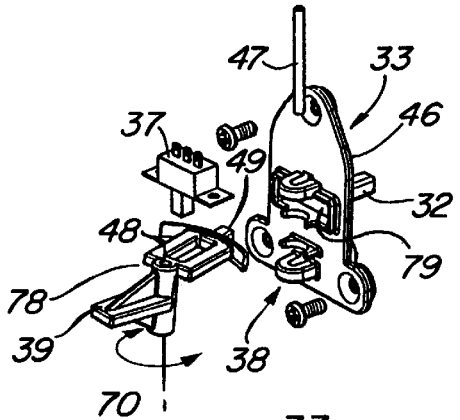
FIG. 3 sets forth a perspective assembly view of the jumping mechanism of the present invention plush toy.
Figure 3:
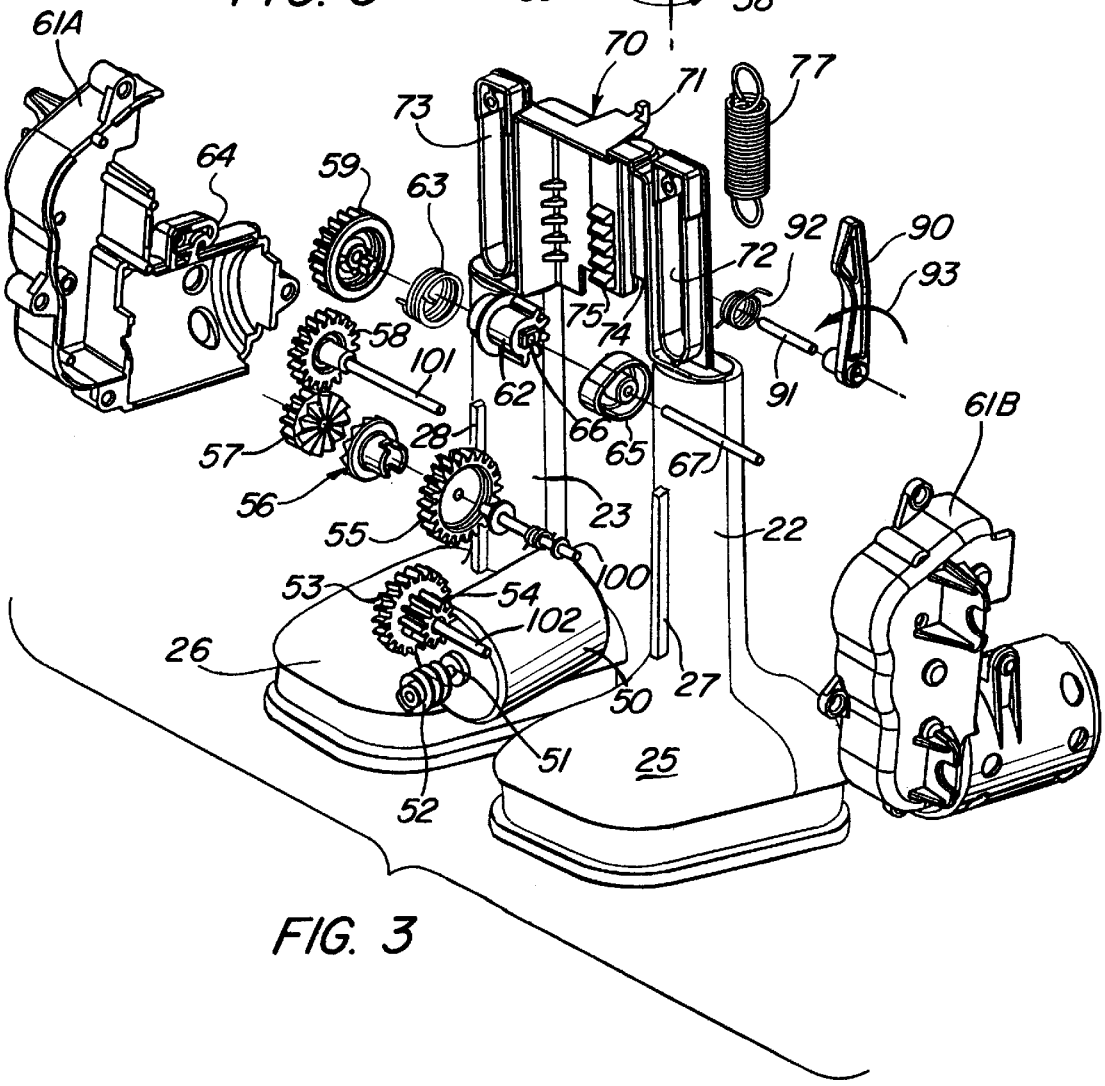

As is better seen in FIG. 3, legs units 22 and 23 are joined by a leg unit bridge 70 which supports a gear rack 75 on the forward center portion thereof. Returning to FIG. 2, it will be seen that leg unit bridge 70 supports gear rack 75 in proximity to segment gear 62. The resulting structure allows segment gear 62 to engage gear rack 75 when the gear teeth of gear segment 62 are rotated into engagement with the teeth of gear rack 75. When the rotational position of gear segment 62 moves its gear teeth out of engagement with gear rack 75, gear segment 62 no longer influences the vertical position of leg unit bridge 70.

Leg unit bridge 70 defines a spring hook 71 which receives one end of a coil spring 77. The remaining end of spring 77 is received upon a hook 64 formed above motor 50 on housing 61. Thus, with housing 61 maintained in a fixed position or stationary position within interior cavity 30 of body housing 20 and with the combined structure of leg units 22 and 23 and leg unit bridge 70 being vertically movable and slidably supported within body housing 20 in accordance with the structure set forth below in FIG. 5, the force of spring 77 provides a resilient spring force which urges the combined structure of leg units 22 and 23 and leg unit bridge 70 downwardly from interior cavity 30 of body housing 20 to the extended position of toy 10.

Thus, with motor 50 inactivated or off and with segment gear 62 rotated to a nonengaging position with gear rack 75, the present invention toy provides a manual mode of operation in which the user is able to grasp either torso 14 or head portion 19 (seen in FIG. 1) and exert a downward force which is communicated to body housing 20 and which drives body housing 20 downwardly upon the combined structure of leg units 22 and 23 and leg unit bridge 70 stretching spring 77. As the user releases toy 10, the force of spring 77 drives the combined structure of leg units 22 and 23 and leg unit bridge 70 downwardly against an underlying play surface such as surface 75 which results in spring body housing 20 upwardly away from the underlying play surface. As a result, the user is able to repeatedly bounce toy 10 along in a manual operation.

The more important mode of operation of the present invention toy, however, takes place when motor 50 is energized and an automatic or repeated bouncing or jumping action takes place. The powered or motor-driven bouncing action of toy 10 is initiated as the user forces torso 14 or head portion 19 (seen in FIG. 1) downwardly with feet 25 and 26 placed upon a surface such as surface 45. The downward force upon torso 14 or head portion 19 is communicated to body housing 20 and forces the body housing downwardly upon leg units 22 and 23 which results in a relative movement between body housing 20 and leg unit bridge 70 upwardly in the direction indicated by arrow 81. This upward motion continues until leg unit bridge 70 reaches the actuator of switch 42 as indicated by arrow 82. It should be noted that the action of on/off switch assembly 33 will be described below in greater detail. However, suffice it note here that the movement of on/off switch button 32 to the on position pivots stop 39 away from the travel path of hook 71 on leg unit bridge 70. Thus, the placement of on/off switch button 32 in the on position moves stop 39 away from the travel path of hook 71 and allows the downward force upon body housing 20 to drive the actuator of switch 42 against the upper surface of leg unit bridge 70 as leg unit bridge 70 reaches the dashed-line position shown at arrow 82.

The actuation of switch 42 causes control unit 40 to activate motor 50. It should be noted that motor 50, control unit 40, switch 42, switch 37, batteries 35 and speaker 43 are provided with appropriate electrical connecting wires which are not shown but which are utilized in accordance with conventional fabrication techniques. Thus, wires are utilized to couple operative power to control unit 40 from batteries 35 and to couple switch 37 to control unit 40. Further, electrical power wires are coupled between control unit 40 and motor 50 while audio or sound signal connecting wires are coupled between control unit 40 and speaker 43. This wiring is entirely in accordance with conventional fabrication techniques and is omitted from FIG. 2 to avoid unduly cluttering the drawing. Thus, with the actuation of switch 42, control unit 40 activates motor 50 producing rotation of shaft 51.

Figure 6:
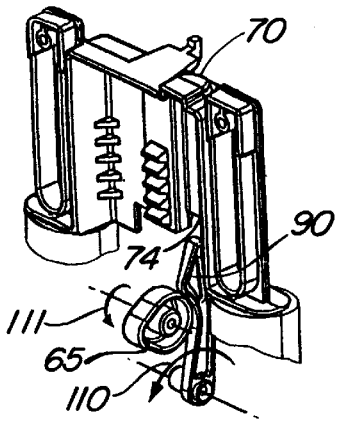
FIG. 6 sets forth a partial perspective view of the latching mechanism operative within the jumping mechanism of the present invention plush toy.

As is set forth below in greater detail and as is seen in FIGS. 3 and 6, a latching mechanism is provided within interior cavity 30 which includes a pivoting latch pawl 90 and a locking surface 74 formed on the underside of leg unit bridge 70. The operation of pawl 90 against leg unit bridge 70 and locking surface 74 (seen in FIG. 6) is set forth below in greater detail. However, suffice it to note here that a latching mechanism thus provided is operative to temporarily latch leg units 22 and 23 and leg unit bridge 70 in the dashed-line position indicated by arrow 82 once the user forces body housing 20 downwardly upon feet 25 and 26 with sufficient force. As a result, plush toy 10 appears to "squat" and remain squatted when the user releases the downward force upon the toy.

With the jumping mechanism latched in the squatting position, the energizing of motor 50 and rotation of output shaft 51 thereof produces rotational motion of worm gear 52. This rotational motion is coupled through the plurality of gears in gear drive unit 60 to provide rotation of cam 65. By means set forth below in greater detail, the rotation of cam 65 causes a pivotal movement of pawl 90 (seen in FIG. 6) away from its latched position releasing the latching mechanism and allowing the energy stored within stretched spring 77 to drive leg unit bridge 70 and leg units 22 and 23 outwardly and downwardly from body housing 20 in the direction indicated by arrow 85. This rapid downward spring driven thrusting motion of leg units 22 and 23 and leg unit bridge 70 produces a downward force upon surface 45 thrusting body housing 20 upwardly causing toy 10 to bounce or jump. The inclined surface on the bottom of feet 25 and 26 causes toy 10 to assume a forwardly inclined attitude with respect to surface 45. As a result, the downward thrusting motion of leg units 22 and 23 launches body housing 20 and, as a result, the entirety of toy 10 forwardly and upwardly as indicated by arrow 86. As spring 77 contracts to the solid-line position shown, toy 10 is launched to the dashed-line position shown. Thereafter, with the energy of spring 77 expended, toy 10 returns to rest upon surface 45 having moved upwardly and forwardly and thereafter settled downwardly to again rest upon the supporting surface. In further accordance with the present invention, the continued rotation of motor 50 rotates cam 65 farther away from pawl 90 and rotates the teeth of gear segment 62 into engagement with gear rack 75. As motor 50 continues to be energized, gear segment 65 rotates in the direction indicated by arrow 80 which in turn raises gear rack 75 and leg unit bridge 70 upwardly within interior cavity 30 in the direction indicated by arrow 81. This upward motion continues and as leg unit bridge 70 continues to be raised, spring 77 is again stretched. As gear segment 62 continues to rotate lifting gear rack 75, the teeth of gear segment 62 rotate out of engagement with gear rack 75. Once this engagement is interrupted, gear segment 62 continues to rotate, however, in the absence of engagement between gear segment 62 and gear rack 75, leg unit bridge 70 is again freely movable and under the urging of spring 77, the combined structure of leg units 22 and 23 and leg unit bridge 70 is again rapidly thrust downwardly in the direction indicated by arrow 84 producing another launching of toy 10 in a bouncing or jumping action. Thus, this cycle repeats as motor 50 continues to be energized and as gear drive unit 60 continues to cause rotation of segment gear 62 into engagement with gear rack 75 and out of engagement to release the gear rack and produce repeated bouncing action.

The operative cycle thus described would continue indefinitely but for the action of a timer 41 within control unit 40. Timer 41 is operative within control unit 40 and is reset with each actuation of switch 42. Timer 41 operates to establish a timed interval for operation of control unit 40 in energizing motor 50. Thus, in the above-described cycle, the actuation of switch 42 which causes control unit 40 to activate motor 50 also resets timer 41 and causes timer 41 to begin timing an operative interval. Once timer 41 has timed out its operative interval, control unit 40 is deactivated and in the absence of a further actuation of switch 42, motor 50 ceases to be activated. In the operation of the present invention bouncing or jumping toy, the effect of timer 41 is to provide a limitation of the number of operative cycles which control unit 40 produces. Once timer 41 has timed out, control unit 40 interrupts the operation of motor 50 and toy 10 becomes inoperative and rests upon surface 45. The resumption of activity by toy 10 requires that the user once again force body housing 20 downwardly with sufficient force to overcome the force of spring 77 and cause the above-described latching of pawl 90 (seen in FIG. 6) and the above-described actuation of switch 42. At this point, toy 10 is again squatting and the above-described cycle is repeated. As a result, each operative cycle of the present invention toy results in a series of bouncing or jumping actions followed by a resting or standing action. Each new cycle is initiated by forcing the upper body portion downwardly upon the underlying surface.

FIG. 3 sets forth a perspective assembly view of gear drive unit 60 together with leg units 22 and 23 and leg bridge unit 70. Also shown in the perspective assembly view of FIG. 3 is switch assembly 33. As described above, leg units 22 and 23 are secured to a leg unit bridge 70. Leg units 22 and 23 are further coupled to feet 25 and 26. Leg unit 22 defines a rib guide 27 while leg unit 23 defines a rib guide 28. Rib guides 27 and 28 function to maintain the proper sliding motion of leg units 22 and 23 within body housing 20 in the manner set forth in FIG. 5. Leg unit bridge 70 further defines a pair of elongated guides 72 and 73 to cooperate to further control the sliding motion of leg unit bridge 70 within body housing 20. Leg unit bridge 70 further includes a gear rack 75, a lock surface 74 and a spring hook 71.

A gear drive unit housing 61 is formed of a pair of mating mirror image housing portions 61A and 61B. Housing portions 61A and 61B nest together to provide the enclosure for the gear drive unit shown as gear drive unit 60 in FIG. 2. An electric motor 50 is received within housing portions 61A and 61B and includes an output shaft 51 supporting a worm gear 52. A compound gear formed of a gear 53 which engages worm gear 52 and a gear 54 are rotatably supported within housing 61 by a shaft 102. A gear 55 supported by a shaft 100 within housing 61 engages gear 54. Shaft 100 further supports a clutch assembly 56 having a gear 57 coupled thereto. Clutch 56 functions to provide a limited strength coupling between gear 55 and gear 57 to avoid damage to the operative mechanism of the gear drive unit should an obstacle or malfunction be encountered. Gear 57 engages a gear 58 supported within housing 61 upon a shaft 101. A gear 59 supported upon a shaft 67 within housing 61 engages gear 58 and is coupled to a segment gear 62 also supported upon shaft 67 by spring coupler 63. Spring coupler 63 provides a resilient coupling between gear 59 and segment gear 62 which further protects the operative mechanism of the gear drive unit. Segment gear 62 includes a square coupling element 66 which engages a cam 65. Cam 65 is also rotatably supported by shaft 67.

A spring 77 has one end coupled to a spring hook 71 formed on leg unit bridge 70 and a remaining end coupled to housing 61 at a hook 64.

A pawl 90 is pivotally supported upon a shaft 91 within housing 61 and is coupled to a spring 92. Spring 92 engages pawl 90 and housing 61 to provide a spring torsional force which urges pawl 90 in pivotal motion about shaft 91 in the direction indicated by arrow 93. Thus, pawl 90 is urged against cam 65 by spring 92.

Switch assembly 33 includes a support plate 46 secured within body housing 20 as seen in FIG. 2. Support plate 46 slidably supports an on/off switch button 32 and further includes a pivot support 38. Pivot 38 receives a pivot pin 47 which passes through passage 48 of switch lever 78. Switch lever 78 further includes an extension 49 which passes through an aperture 79 in support plate 46 to engage and partially support on/off switch button 32. Switch lever 78 further includes a stop 39.

In operation, with switch lever 78 pivotally secured within pivot 38 by pin 47, an electrical switch 37 is coupled to switch lever 78 in the manner seen in FIG. 2. The combined structure provides pivotal motion of switch lever 78 in response to lateral motion of on/off button 32 which actuates electrical switch 37 and which moves stop 39 to or from the travel path of spring hook 71 in the action described above in FIG. 2. Thus, with switch button 32 moved to the off position, switch lever 78 is correspondingly pivoted turning electrical switch 37 to its off position and pivoting stop 39 into an obstruction position within the travel path of spring hook 71. As a result, the above-described actuation of switch 42 produced by upward motion of leg unit bridge 70 is prevented. Conversely, with switch button 32 moved to the on position, switch lever 78 pivots to simultaneously actuate electric switch 37 and pivot stop 39 away from the travel path of switch hook 71. This in turn allows complete upward motion of leg unit bridge 70 to actuate switch 42 as indicated in FIG. 2.

Figure 4:
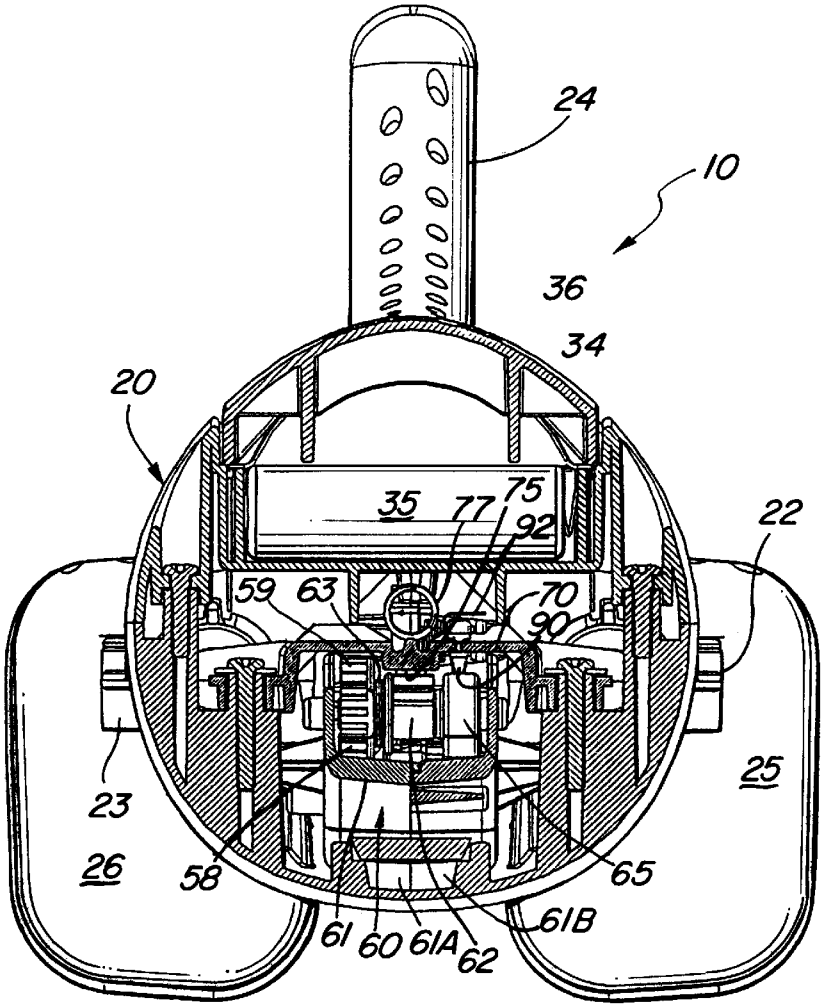
FIG. 4 sets forth a section view of the jumping mechanism of the present invention plush toy taken along section lines 4—4 in FIG. 2.

FIG. 4 sets forth a section view of toy 10 taken along section lines 4—4 in FIG. 2. Once again, to avoid unduly cluttering the drawing figure, outer body 11 has been omitted from FIG. 4. As described above, toy 10 includes a body housing 20 having a battery compartment 34 and a battery compartment door 36 supported thereon. Within compartment 34, a plurality of batteries 35 are supported. Also supported within battery compartment 34 are a plurality of conventional electrical connecting terminals for providing electrical connections to batteries 35. Body housing 20 is supported by a tail portion 24 and a pair of leg units 22 and 23 having feet 25 and 26 respectively. As described above, leg units 22 and 23 are joined by a leg unit bridge 70 which supports a gear rack 75. A gear drive unit 60 includes a housing 61 formed of housing portions 61A and 61B includes a gear 58 coupled to a gear 59 which in turn is coupled to a gear segment 62 by a spring coupler 63. A cam 65 is rotatably supported within housing 61 and is coupled to gear segment 62. As is better seen in FIG. 6, a pawl 90 is pivotally supported by housing 61 and is urged toward cam 65 by a spring 92 (seen in FIG. 3). A coil spring 77 is coupled between housing 61 and leg unit bridge 70 in the manner seen in FIG. 2.

Figure 5:
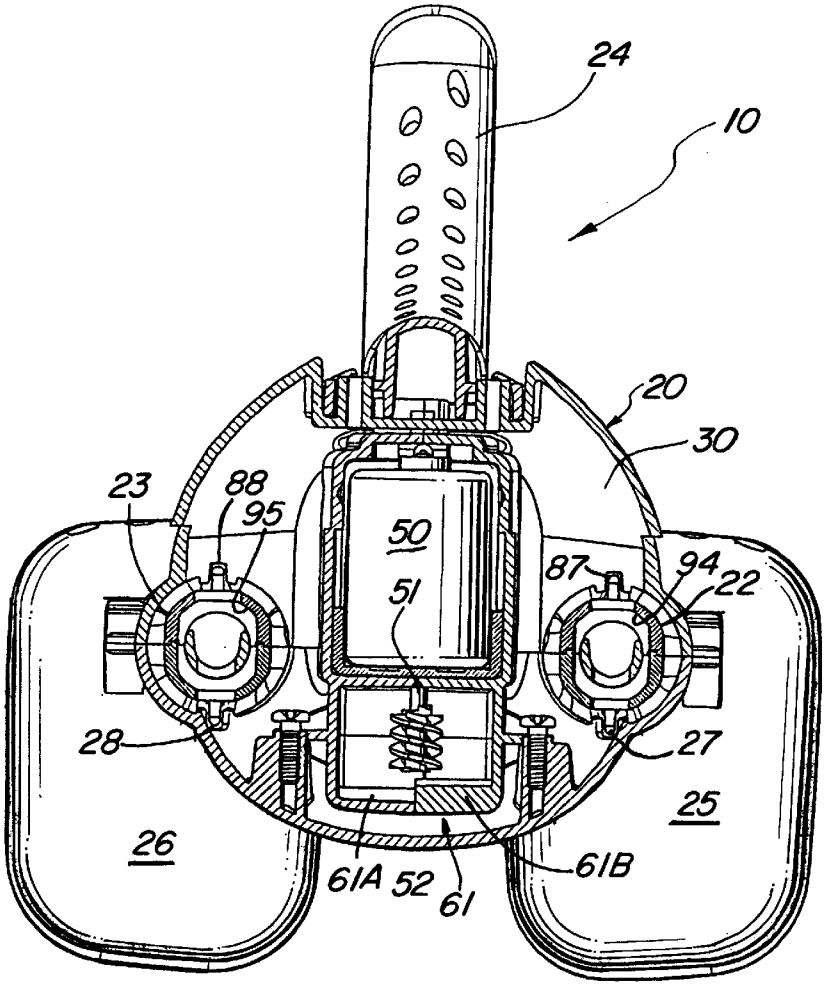
FIG. 5 sets forth a section view of the jumping mechanism of the present invention plush toy taken along section lines 5—5 in FIG. 2.

FIG. 5 sets forth a section view of toy 10 taken along section lines 5—5 in FIG. 2. Once again, it will be understood that outer body covering 11 has been omitted from the drawing of FIG. 5 to avoid unduly cluttering the drawing figure. As described above, toy FIG. 10 includes a body housing 20 defining an interior cavity 30 and supporting a tail 24. Body housing 20 further supports a housing 61 formed of housing portions 61A and 61B. Housing 61 supports a motor 50 having an output shaft 51 which in turn supports a worm gear 52.

As is also described above, toy 10 includes a pair of leg units 22 and 23 having feet 25 and 26 supported thereby. Leg units 22 and 23 are slidably supported within passages 94 and 95 formed within interior cavity 30 of body housing 20. Leg unit 22 defines oppositely positioned guiding ribs 27 and 87 which are received within corresponding guidance channels formed in body housing 20 to provide vertical motion as leg unit 20 slides within channel 94. Similarly, leg unit 23 includes guiding ribs 28 and 88 received within corresponding vertical channels formed in body housing 20 whereby leg unit 23 is slidably received within passage 95 formed in body housing 20. As a result, leg units 22 and 23 are smoothly slidable in vertical motion with respect to body housing 20.

FIG. 6 sets forth a partial perspective assembly view of the interlocking or latching mechanism provided by pawl 90, leg unit bridge 70 and cam 65. FIG. 6 is provided to illustrate the spatial relationships between pawl 90, leg unit bridge 70 and cam 65. Thus, the various support apparatus which support pawl 90 and cam 65 are better seen in FIGS. 3 and FIG. 2 described above. The importance of FIG. 6 is to show the spatial relationship between pawl 90 and locking surface 74 of leg unit bridge 70. Thus, pawl 90 is urged toward cam 65 in the direction indicated by arrow 110 through the action of spring 92 (seen in FIG. 3). As a result, the upward motion of leg unit bridge 70 described above and shown in FIG. 2 which occurs when the user forces the body portion of toy 10 downwardly to the squatting position allows leg unit bridge 70 to move upwardly a sufficient distance to permit pawl 90 to pivot in the direction indicated by arrow 110 bringing the upper edge of pawl 90 into alignment with lock surface 74. The position of cam 65 as shown facilitates this inward movement of pawl 90. The interaction of the upper edge of pawl 90 and lock surface 74 prevents downward motion of leg unit bridge 70. As a result, an interlock which maintains the toy figure in a "squat" position described above results. As is set forth above in FIG. 2 and described in conjunction therewith, the present invention toy figure remains in the squatted position as cam 65 is rotated in the direction indicated by arrow 111. As the eccentric lobe of cam 65 is rotated into contact with pawl 90, pawl 90 is pivoted away from edge 74 and the interlock feature is defeated. This allows the initiation of a bouncing or jumping cycle by toy 10.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy having a jumping action comprising:

a body housing defining an interior cavity having a battery therein;

a leg bridge supporting a pair of leg units and a pair of feet thereon, said leg bridge and said pair of leg units being slidably supported by said body housing between an extended position and a retracted position;

a motor gear drive operative upon said leg bridge to move said leg units from said extended position to said retracted position and releasing said leg bridge;

a latch supported within said body housing having a movable pawl locking said leg bridge in said retracted position;

a latch release operated by said gear drive to release said latch by moving said movable pawl;

a switch operatively coupling said battery to said motor gear drive, said switch being actuated by said leg bridge in said retracted position to energize said motor gear drive;

spring means for urging said leg bridge and said pair of leg units toward said extended position, said toy being activated by forcing said housing downwardly overcoming said spring and moving said leg bridge and said pair of legs to said retracted position causing said latch to lock said leg bridge in said retracted position and causing said switch to energize said motor drive gear which in turn releases said latch and releases said leg bridge to thrust said leg bridge and pair of legs toward said extended position causing said toy to jump.

2. The toy set forth in claim 1 further including a timer triggered by said switch and initiating operation of said motor gear drive during a timed interval.

3. The toy set forth in claim 2 wherein said leg bridge supports a gear rack and wherein said motor gear drive includes a rotatable gear segment engaging retracting and releasing said gear rack as said gear segment rotates.

4. The toy set forth in claim 3 wherein said pair of feet each define a bottom surface, said bottom surfaces supporting said toy in a forwardly tilted orientation.

5. The toy set forth in claim 1 wherein said leg bridge supports a gear rack and wherein said motor gear drive includes a rotatable gear segment engaging retracting and releasing said gear rack as said gear segment rotates.

6. The toy set forth in claim 5 wherein said pair of feet each define a bottom surface, said bottom surfaces supporting said toy in a forwardly tilted orientation.

7. A toy having a jumping action comprising:

a body housing defining an interior cavity;

a pair of legs supported by said housing and movable between an extended position and a retracted position partially within said interior cavity;

a spring coupled to said pair of legs urging said pair of legs toward said extended position;

drive means, coupled to said pair of legs, for repeatedly driving said pair of legs to said retracted position and releasing said pair of legs to allow said spring to thrust said pair of legs to said extended position and cause said toy to jump;

a timer operating said drive means for a time interval said timer initiated by a user pushing said body downward upon said legs and forcing said legs to said retracted position; and latch means operative in response to forcing said housing downwardly and driving said pair of legs to said retracted position, said latch means being released by said drive means.

8. The toy set forth in claim 7 wherein said drive means includes a latch means release cam rotatable by said drive means.

* * * * *